US006290219B1

(12) United States Patent
Barbosa

(10) Patent No.: US 6,290,219 B1
(45) Date of Patent: Sep. 18, 2001

(54) C-CLAMP PLIER WITH SUPPORT EXTENSION ARM

(76) Inventor: Scott Barbosa, 67 Woodcock La., Levittown, NY (US) 11756

( * ) Notice: Subject to any disclaimer, the term of this patent is extended or adjusted under 35 U.S.C. 154(b) by 0 days.

(21) Appl. No.: 09/668,717

(22) Filed: Sep. 22, 2000

(51) Int. Cl.[7] ..... B25B 1/00
(52) U.S. Cl. ..... 269/756; 269/155
(58) Field of Search ..... 269/152, 153, 269/154, 155, 156, 283, 97, 98, 249, 43, 45

(56) References Cited

U.S. PATENT DOCUMENTS 1,402,621 * 1/1922 Knittel et al. ..... 269/156
1,497,107 * 6/1924 Lasell ..... 269/156
2,610,661 * 9/1952 Romine ..... 269/156
2,642,905 * 6/1953 Hewatt ..... 269/156
4,505,011 * 3/1985 Dupuy ..... 24/540
4,592,541 * 6/1986 Huray ..... 269/155
4,962,918 * 10/1990 Yang ..... 269/156
5,058,869 * 10/1991 Ruthven ..... 269/45

* cited by examiner

*Primary Examiner*—Derris H. Banks
*Assistant Examiner*—Daniel Shanley

(57) ABSTRACT

The present invention provides a C-clamp plier with a support extension arm for grasping and longitudinally supporting one or more objects. The plier of the invention generally comprises a handle assembly, a C-shaped clamping section, and an extension arm disposed above one of the jaws of the C-shaped clamping section and adjustably extending longitudinally to an outer-point. A pressure post is provided at an outer end of the extension arm and a counter pressure post is provided within the jaws of the C-shaped clamping section to provide opposed counteracting forces along the longitude of one or more objects grasped by the plier to secure the object(s) stably within the grasp of the plier.

9 Claims, 3 Drawing Sheets

C-CLAMP PLIER WITH SUPPORT EXTENSION ARM

BACKGROUND OF THE INVENTION

The present invention concerns clamping pliers. In particular, the invention concerns a clamping plier with a support extension arm for grasping and longitudinally supporting one or more objects. The clamping plier of the present invention is particularly useful for clamping and stabilizing objects that are relatively long and otherwise unmanageable when grasped by conventional clamping pliers.

In the field of autobody repair, a mechanic repairing a damaged or rusted portion on the body of a vehicle, such as a fender or quarter panel, must often weld sheet metal replacement panels to the surviving metal on the vehicle. Typically, the autobody mechanic will cut away the damaged or rotted metal on the panel and will prepare the remaining intact metal to receive a replacement panel. The mechanic will then form a replacement panel from a piece of sheet metal to fill the void created by the cutaway metal. The mechanic will weld the edges of the replacement panel to the remaining intact metal. To accomplish the welding step, the mechanic must hold the replacement panel accurately in line with the remaining intact metal; otherwise the panel will not be properly oriented on the automobile as the welding step is carried out. To hold the panel in place during welding, mechanics have traditionally used clamping devices, which are available in various sizes and shapes.

One clamp that mechanics typically use in autobody repair is a locking C-clamp plier. A mechanic will use a locking C-clamp plier to fasten the replacement panel to the remaining intact metal. Conventional locking C-clamps suffer, however, in that they cannot be used efficiently to secure large sheets of metal. When a mechanic uses a conventional C-clamp to fasten one end of a large sheet of metal to the intact metal on the auto, the opposed end of the replacement sheet inevitably protrudes or bows out making it very difficult to align that end with the corresponding intact metal to which it must be welded. This makes it very difficult to weld the replacement metal sheet to the remaining intact metal on the auto.

The present invention solves the above-referenced problem and many other drawbacks associated with the prior art clamping pliers.

SUMMARY OF THE INVENTION

The present invention provides a C-clamp plier with a support extension arm for grasping and longitudinally supporting one or more objects. The plier of the invention generally comprises a handle assembly, a C-shaped clamping section, an extension arm disposed above one of the jaws of the C-shaped clamping section and adjustably extending longitudinally to an outer-point, and a pressure post and counter-pressure post for providing counteracting forces on either side of the point where the tips of the C-clamp come together.

The C-shaped clamping section is connected to and actuated by the handle assembly to an opened or closed position. The C-shaped clamping section includes upper and lower curved jaws ending at opposed tips. The tips come together at a point when the clamping section is in the closed position for grasping an object placed between the tips. The tips are adapted to grasp the object a first point along the longitude of the object. In a preferred embodiment, the C-shaped clamping section has a locking mechanism for locking the clamping section in the closed position. In addition, the handle may include an adjustment mechanism for adjusting the distance between the clamping tips when the clamping section is in the closed position.

The extension arm is attached to the upper jaw and extends longitudinally beyond the clamping section to an outer end. The length of the extension arm is adjustable so that the distance between the clamping section and the outer end may be varied as needed. The extension arm is preferably attached to the upper jaw in a slidable arrangement, such that the distance between the clamping section and the outer end of the extension arm may be varied simply by sliding the arm.

A pressure post mounted to the extension arm at the outer end is disposed approximately perpendicular to the extension arm. The pressure post is displaceable vertically so as to be adjustable in height. The pressure post has a lower end (with an optional swivel foot) for pressing against the object at a second point along the longitude of the object that is outside of the first point.

A counter-pressure post is mounted within the upper curved jaw. The counter-pressure post is preferably disposed approximately perpendicular to the extension arm. In addition, the counter-pressure post is preferably slidably mounted and may be moved to various locations within the upper curved jaw. When an object is grasped within the opposed tips at a first point on the longitude of the object and the pressure post is displaced such that the lower end presses against the object at the second point, the object will begin to rotate about the first point until the counter-pressure post presses against the object at the third point along the longitude of the object that is inside of the first point. The downward pressure applied by the pressure post has the tendency to drive the end of the object in a downward direction. Since the mid-point of the object is grasped within the tips of the clamping section, the first point where the opposed tips grasp the object serves as a fulcrum point. The force exerted by the counter-pressure post will stop the rotation of the object about the first point. Consequently, the forces on the object at the second and third points on opposed sides of the first point provide longitudinal support and stability for stabilizing the object within the clamping section.

The invention also provides an support extension assembly that may be used with a variety of clamping devices to provide longitudinal support to objects grasped by the claming device. The support extension assembly comprises an extension arm attached to the clamp and extending longitudinally beyond the clamping section to an outer end. A pressure post is mounted to the extension arm at the outer end, and the pressure post has a lower end for pressing against the objects at a point on one side of the clamp. A counter-pressure post is mounted either to the arm or the clamping device itself and is disposed for pressing against the object(s) at a point one the opposite side of the clamp. The forces applied on the objects by the pressure post and counter-pressure post on opposite sides of the clamp provide longitudinal support and stability for stabilizing the object(s) within the clamp.

DETAILED DESCRIPTION OF THE PREFERRED EMBODIMENT

Figure 1:
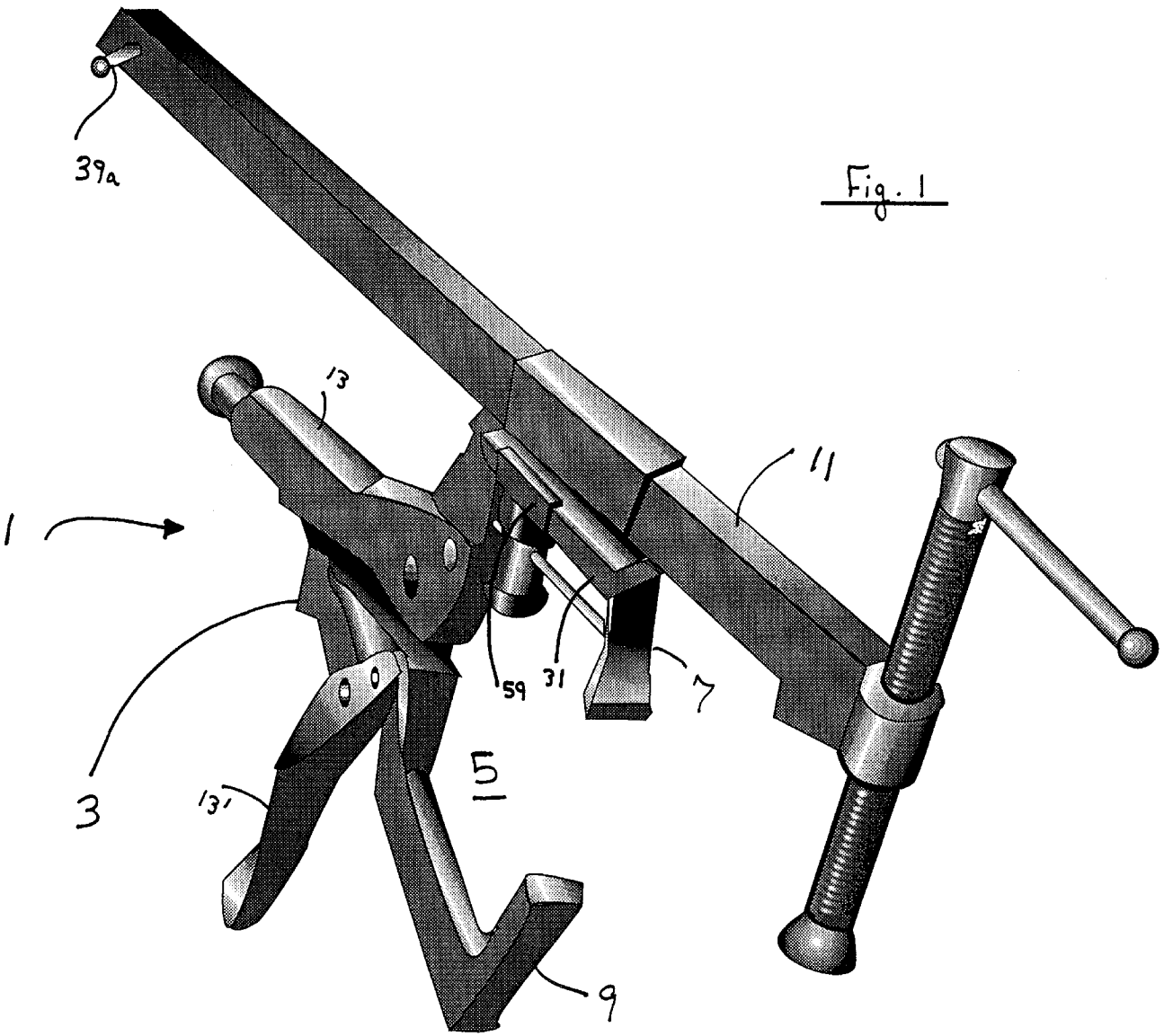
FIG. 1 is a perspective view of the C-clamp plier with support extension arm of the invention.

Referring to FIG. 1, the C-clamp plier with support extension arm 1 comprises a handle assembly 3, a C-shaped clamping section 5 composed of upper and lower curved jaws 7 and 9, and an extension arm 11 slidably mounted on the upper jaw 7 of the clamping section 5.

Figure 2:
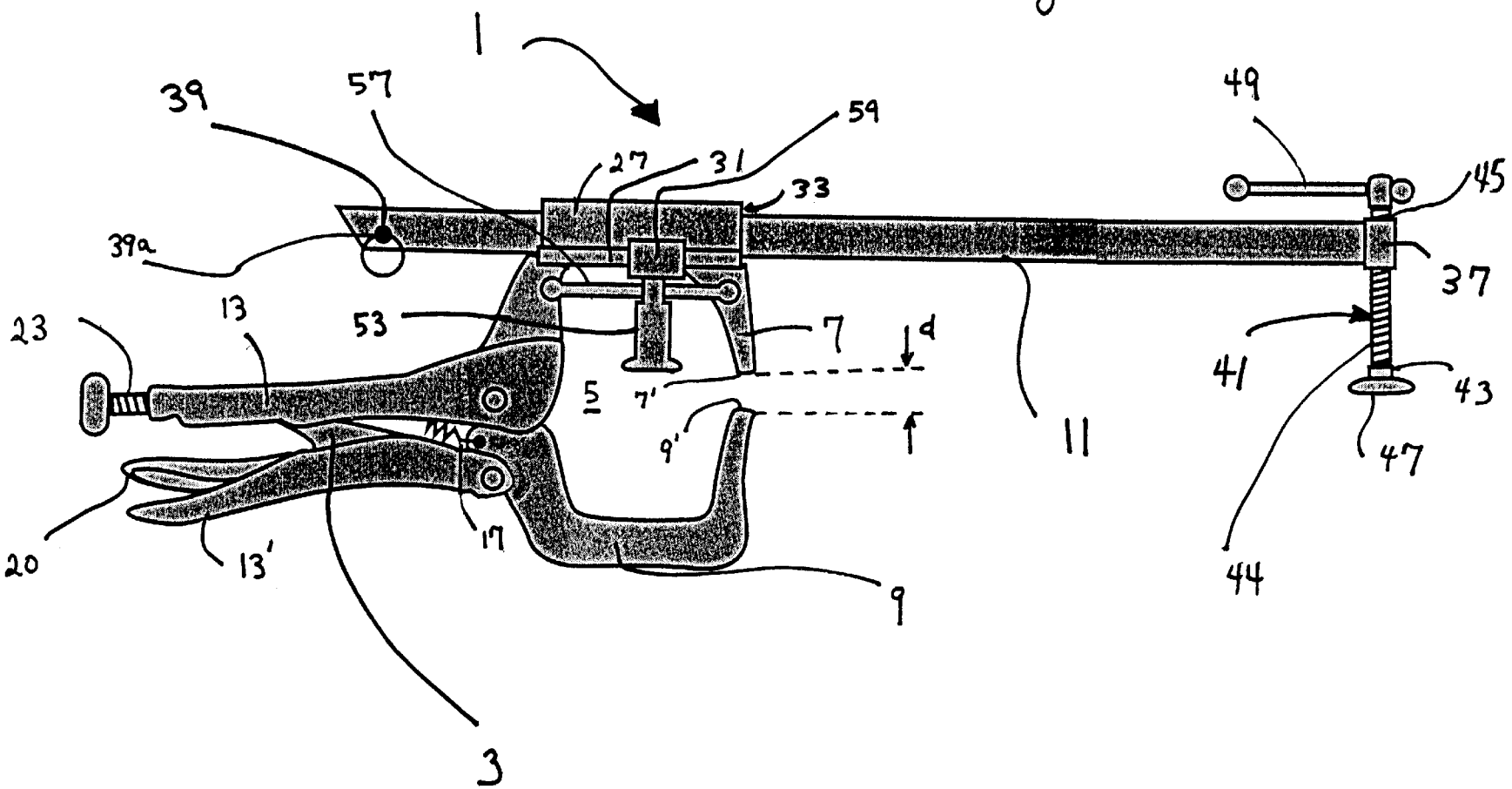
FIG. 2 is a side view of the C-clamp plier with support extension arm of the invention.

In FIG. 2, the handle assembly 3 includes upper and lower handles 13 and 13'. The handle assembly 3 also includes a locking mechanism composed of a spring mechanism 17 and a release latch 20. The handle assembly 3 also includes an adjustment screw 23 that is turned to adjust the distance "d" between the opposed tips 7' and 9' of the upper and lower jaws 7 and 9, respectively.

The C-shaped clamping section 5 is attached to the handle assembly 3 and is actuated to opened and closed positions by the handle assembly 5. When the handle assembly 5 is grasped and closed, the C-shaped clamping section 5 is actuated to a closed position and the opposed tips 7' and 9' come together to grasp an object at a first point along the longitude of the object. Rotation of the adjustment screw 23 on the handle assembly 5 will adjust the distance "d" between the opposed tips when the C-shaped clamping section 5 is in the closed locked position.

A track-guide 27 is mounted above upper curved jaw 7 and includes a track lip 31 on its exterior and a channel guide 33 on its interior. Extension arm 11 is slidably disposed within the channel guide 33. The extension arm 11 includes an outer end 37 and an inner end 39, which includes a stop post 39*a* to prevent the extension arm 11 from sliding entirely out of the channel guide 33. A pressure post 41 is mounted to the outer end 37 and is disposed approximately perpendicular to the extension arm 11. The pressure post 41 has a lower end 43, which optionally includes a swivel foot 47. The pressure post 41 has an externally threaded section 44 engaged in a complementary threaded portion 45 of the extension arm 11. A turn-post 49 is slidably mounted to the pressure post 41. A force may be imparted on the turn-post 49 to rotate the pressure post 41 relative to the extension arm and consequently adjust the position of the lower end 43 (and swivel foot 47 if used).

A counter-pressure post 53 is slidably disposed along a rod 57 disposed within the upper jaw 7 of the clamping section 5. A shoulder-track 59 is attached to the upper portion of the counter-pressure post 53 and slidably engages the track lip 31 of the track guide 27. (also see FIG. 1).

Figure 3:
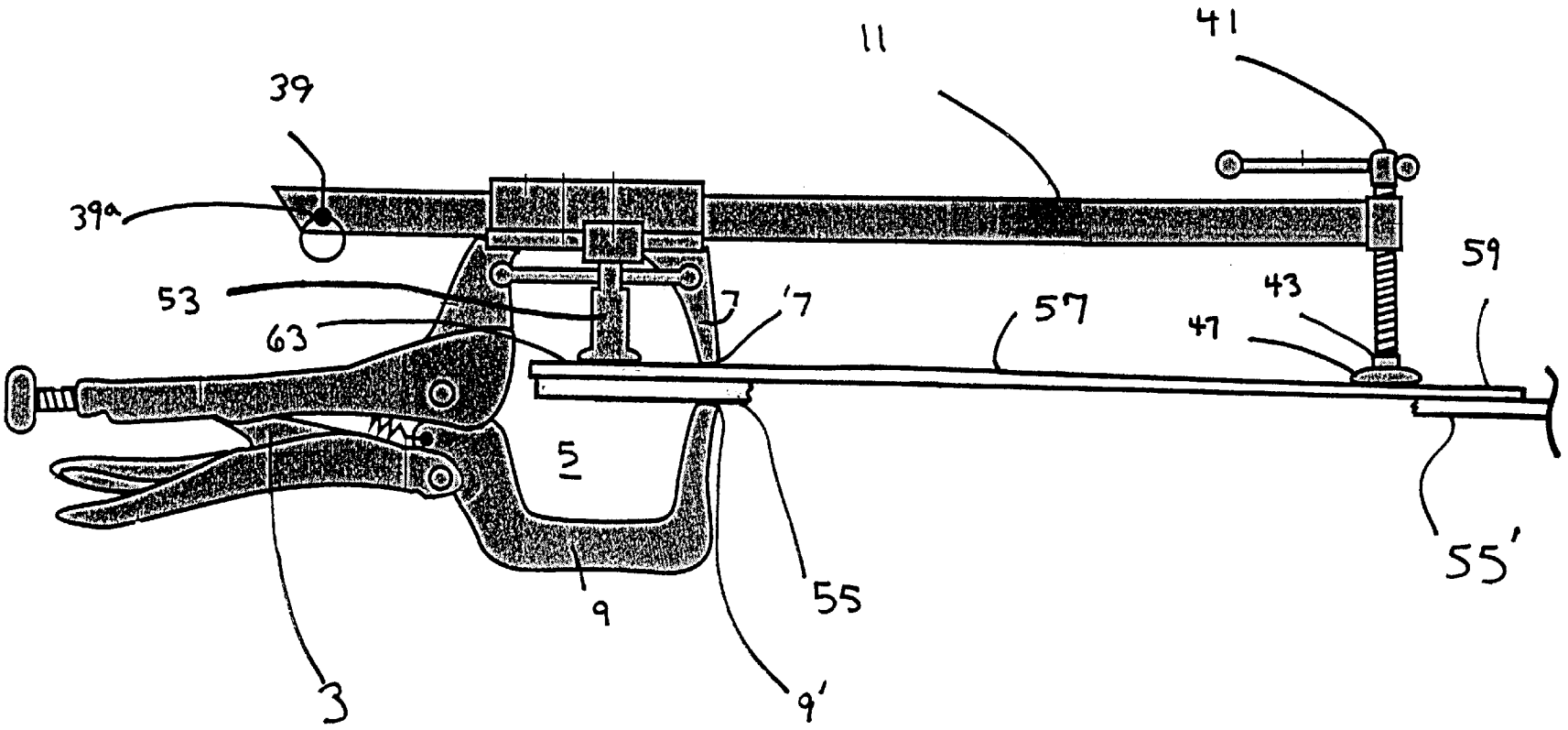
FIG. 3 is a side view of the C-clamp plier with support extension arm in use clamping a replacement sheet metal panel to existing metal in an autobody application.

FIG. 3 shows the C-clamp plier of the invention in operation in connection with the repair of damaged or rusted portion on the body of an automobile. After the autobody mechanic has cut away the damaged or rotted metal on the panel, the remaining intact metal 55 and 55' is ready to receive a replacement panel 57. To secure the replacement panel 57 accurately in place for subsequent welding to the remaining intact metal 55 and 55', the mechanic will use the C-clamp of the invention as follows. The mechanic places the C-clamp plier in an appropriate position and using the handle assembly 3 actuates the C-shaped clamping section 5 to a closed position, wherein the opposed tip 7' and 9' of the upper and lower jaws 7 and 9, respectively, will grasp the remaining intact metal 55 and replacement panel 57 at a first point and pinch them together. In most applications involving relatively large replacement panels, the far end 59 of the replacement panel 57 would tend to bow in an upward direction away from the remaining intact metal 55' at the corresponding location. To counteract this problem, extension arm 11 may be slidably extended to a point where the pressure post 41 is disposed over the far end 59 of the replacement panel 57. The pressure post 41 may then be rotated to adjust the position of the lower end 43 and eventually cause the swivel foot 47 to press against the far end 59 at a second point on the replacement panel, which is outside of the first point. Using this arrangement, the mechanic may adjust the position of the lower end 43 (and swivel foot 47) to a position where the far end 59 of the replacement panel 57 comes into direct secure contact with the remaining intact metal 55' at that corresponding location. As the far end 59 of the replacement panel 57 is moved down toward the intact metal 55' the replacement panel 57 tends to rotate clockwise about the first point, which would cause the near end 63 of the replacement to move upward and away from the remaining intact metal 55 at the location. To counteract this effect, the counter-pressure post 53 is positioned to press against the near end 63, which is at third point along the replacement panel 57 inside of the first point. The counter-pressure post 53 prevents the near end 63 from moving away from the intact metal 55. In this arrangement, the point where the opposed ends 7' and 9' pinch the replacement panel 57 and the intact metal 55 acts as fulcrum point and the counteracting forces exerted by the pressure post 41 and counter-pressure post 53 on the replacement panel serve to stabilize the panel in position so that the mechanic may thereafter weld the replacement panel 57 to the remaining intact metal 55 and 55'.

It is envisioned that the C-clamp plier with support extension arm of the invention may be used in a variety of applications for securely and stably clamping relatively long materials. For instance, it is envisioned that the inventive plier may be used to clamp long panels of wood, polymer composite materials and the like. It is also envisioned that the inventive plier may be adapted for use in a work bench setting where one or more parts of the plier is secured to or made as an integral part of the bench. It is also envisioned that the inventive plier may be used to fasten many objects simultaneously in a secure and stable fashion. Finally, it is envisioned that the extension arm of the invention may be used with other clamping devices, such as ordinary C-clamps. The scope of the invention is set forth in the following claims and should not be limited in any way by the foregoing embodiments.

What is claimed is:

1. A C-clamp plier and support extension arm for grasping and longitudinally supporting one or more objects, the plier comprising:

a handle assembly;

a C-shaped clamping section attached to and actuated by the handle to an opened or closed position, the C-shaped clamping section including upper and lower curved jaws ending at opposed tips, the tips coming together when the clamping section is in the closed position for grasping the object(s) at a first point along the longitude of the object(s);

an extension arm attached to the upper jaw and extending longitudinally beyond the opposed tips of the clamping section to an outer end;

a pressure post mounted to the extension arm at the outer end, the pressure post having a foot for pressing against the object(s) at a second point along the longitude of the object(s) that is outside of the first point; and a counter-pressure post mounted within the upper curved jaw, the counter-pressure post for pressing against the object(s) at a third point along the longitude of the object(s) that is inside of the first point;

wherein the pressure applied by the pressure post and counter-pressure post at the second and third points on opposite sides of the first point provide longitudinal support and stability for stabilizing the object(s) within the clamping section.

2. A C-clamp plier and support extension arm according to claim 1, wherein the extension arm has an adjustable length.

3. A C-clamp plier and support extension arm according to claim 1, wherein the extension arm is slidably attached to the upper jaw.

4. A C-clamp plier and support extension arm according to claim 1, wherein the handle assembly includes a locking mechanism for locking the clamping section in the closed position.

5. A C-clamp plier and support extension arm according to claim 1, wherein the handle includes an adjustment mechanism for adjusting the distance between the clamping tips when the clamping section is in the closed position.

6. A C-clamp plier and support extension arm according to claim 1, wherein the pressure post is disposed approximately perpendicular to the extension arm and is adjustable in height.

7. A C-clamp plier and support extension arm according to claim 6, wherein the extension arm has an internally threaded opening and wherein pressure post has external threads complementing the internally threaded opening and the pressure post is threaded in the internally threaded opening for adjusting the height of the foot on the pressure post.

8. A C-clamp plier and support extension arm according to claim 7, wherein the foot of the pressure post is a swivel foot for applying pressure.

9. A support extension assembly for a clamp, the assembly for longitudinally supporting one or more objects grasped by the clamp, the assembly comprising:

an extension arm attached to the clamp and extending longitudinally beyond the clamping section to an outer end;

a pressure post mounted to the extension arm at the outer end, the pressure post having a lower end for pressing against the object(s) at a point on one side of the clamp; and a counter-pressure post disposed for pressing against the object(s) at a point one the opposite side of the clamp;

wherein the pressure applied by the pressure post and counter-pressure post on opposite sides of the clamp provide longitudinal support and stability for stabilizing the object(s) within the clamp.

* * * * *